US006000056A

United States Patent [19]

Brady et al.

[11] Patent Number: 6,000,056

[45] Date of Patent: Dec. 14, 1999

[54] DISPOSABLE BIB ADAPTED TO CARRY ARTICLES FOR USE IN FEEDING

[76] Inventors: Dennis P. Brady; Elizabeth A. Brady, both of 119 Camp Council Rd., Phoenixville, Pa. 19460

[21] Appl. No.: 09/113,688

[22] Filed: Jul. 10, 1998

[51] Int. Cl.[6] ..... A41B 13/00

[52] U.S. Cl. ..... 2/49.1; 2/49.2

[58] Field of Search ..... 2/48, 49.1, 49.2, 2/49.4, 51, 94

[56] References Cited

U.S. PATENT DOCUMENTS

| | | |
|---|---|---|
| 298,985 | 5/1884 | Kimball . |
| D. 366,315 | 1/1996 | Oranday . |
| D. 376,679 | 12/1996 | Edens et al. . |
| D. 380,829 | 7/1997 | Breault . |
| 1,797,208 | 3/1931 | Weisz . |
| 2,563,420 | 8/1951 | Roe . |
| 2,607,040 | 8/1952 | Zaleski . |
| 2,651,039 | 9/1953 | Tonkens et al. . |
| 2,674,738 | 4/1954 | Mehlos . |
| 2,708,273 | 5/1955 | Bonaventura . |
| 3,115,639 | 12/1963 | Moszczynski . |
| 3,629,865 | 12/1971 | Weiner . |
| 4,779,288 | 10/1988 | Mack . |
| 4,924,527 | 5/1990 | Hintermeyer . |
| 5,042,091 | 8/1991 | Tonkens . |
| 5,046,980 | 9/1991 | Tai et al. . |
| 5,244,278 | 9/1993 | Robitaille . |
| 5,483,701 | 1/1996 | Ferreyros . |
| 5,490,289 | 2/1996 | Lehrer . |
| 5,491,844 | 2/1996 | Kehl et al. . |
| 5,509,141 | 4/1996 | Saltzman . |
| 5,531,730 | 7/1996 | Dreier . |
| 5,542,940 | 8/1996 | Jonker . |
| 5,558,661 | 9/1996 | Roe et al. . |
| 5,570,474 | 11/1996 | Berry et al. . |
| 5,571,097 | 11/1996 | Seth . |
| 5,582,605 | 12/1996 | Lepie . |
| 5,584,828 | 12/1996 | Yamamoto et al. . |
| 5,601,543 | 2/1997 | Dreier et al. . |
| 5,601,546 | 2/1997 | Tanji et al. . |
| 5,611,789 | 3/1997 | Seth . |
| 5,618,280 | 4/1997 | Glackin et al. . |
| 5,624,424 | 4/1997 | Saisaka et al. . |
| 5,626,574 | 5/1997 | Sasaki et al. . |
| 5,640,715 | 6/1997 | Adams . |
| 5,644,793 | 7/1997 | Lahaussois et al. . |
| 5,662,637 | 9/1997 | Kitaoka et al. . |
| 5,681,299 | 10/1997 | Brown . |
| 5,875,490 | 3/1999 | Woodard et al. . |

*Primary Examiner*—Amy Vanatta
*Assistant Examiner*—Shirra L. Jenkins
*Attorney, Agent, or Firm*—Frishhauf, Holtz, Goodman, Langer & Chick, P.C.; Robert P. Michal

[57] ABSTRACT

The disposable bib includes a panel adapted to overlie a chest region of a wearer having a first surface designed to face outwardly from the wearer, a second surface designed to face toward the wearer, and a compartment(s) formed on or within the second surface of the panel for containing at least one of an eating utensil and a towelette therein.

20 Claims, 4 Drawing Sheets

DISPOSABLE BIB ADAPTED TO CARRY ARTICLES FOR USE IN FEEDING

FIELD OF THE INVENTION

The present invention relates to bibs, and more particularly to a disposable bib having articles contained therein for use in feeding a person who is wearing the bib.

BACKGROUND OF THE INVENTION

When a parent (or a caregiver) intends to take an infant away from home during a time period in which it will be necessary to feed the infant, the parent must not only remember to pack food for the infant to eat, but the parent must also pack a bib to prevent the infant's clothes from becoming stained, utensils to provide the food to the infant, and napkins or towelettes for cleaning the infant's face and hands after the meal.

If the parent is distracted or hurried when leaving home, one or more of the aforementioned items may be forgotten. The parent normally realizes that an item for use in feeding the infant has been forgotten only when the parent is preparing to feed the infant. If food is forgotten, an adequate substitute can usually be obtained at an eating establishment, grocery store or convenience store. However, when either a bib, utensil or towelette is forgotten, it is typically difficult to locate a store to purchase an adequate substitute. Therefore substantial time can be expended in an attempt to locate a store when the infant should instead be fed. Even if a store is located by the parent, inexpensive, temporary substitutes are not usually available. Therefore, a relatively significant expenditure may be required even though an item similar to the one being purchased is already owned by the parent and the purchased item is only to serve as a temporary substitute for the forgotten item.

SUMMARY OF THE INVENTION

The present invention overcomes the described drawbacks and provides a new and unique arrangement which has the capacity to provide a disposable bib including utensils and towelettes incorporated therein such that a parent need only remember to bring the bib which substantially reduces the likelihood that the items necessary to feed an infant will be forgotten.

In accordance with one form of the present invention, the disposable bib arrangement includes a panel adapted to overlie a chest region of a wearer having a first surface designed to face outwardly from the wearer, a second surface designed to face toward the wearer, and a compartment formed on or within the second surface of the panel for containing at least one of an eating utensil and a towelette therein.

In accordance with another form of the present invention, a combination includes a disposable bib comprising a panel adapted to overlie a chest region of a wearer having a first surface designed to face outwardly from the wearer, a second surface designed to face toward the wearer, and a compartment formed on or within one of the first and second surfaces of the panel. The combination also includes at least one of an eating utensil and a towelette.

In accordance with another form of the present invention, a method of disposing of a disposable bib includes the steps of providing a disposable bib including a panel adapted to overlie the chest region of a wearer having a first surface designed to face outwardly from the wearer, a second surface designed to face toward the wearer, and a compartment formed on or within the second surface of the panel for containing at least one of an eating utensil and a towelette therein. The method also includes the steps of providing the compartment in an inside-out orientation, and inserting the disposable bib in the inside-out oriented compartment.

In accordance with another form of the present invention, a method of feeding a person using a disposable bib including a panel adapted to overlie a chest region of the person having a first surface designed to face outwardly from the person, a second surface designed to face toward the person, and a compartment formed on or within the second surface of the panel for containing an eating utensil therein includes the steps of removing the eating utensil from the first compartment of the disposable bib, securing the disposable bib about a person's neck such that the panel overlies the chest region of the person, utilizing the eating utensil removed from the disposable bib to provide food to the person, and removing the disposable bib from the person's neck.

The above features and advantages of the present invention will become readily apparent from the following detailed description thereof, which is to be read in connection with the accompanying drawings.

DETAILED DESCRIPTION OF THE PREFERRED EMBODIMENTS

Figure 1:
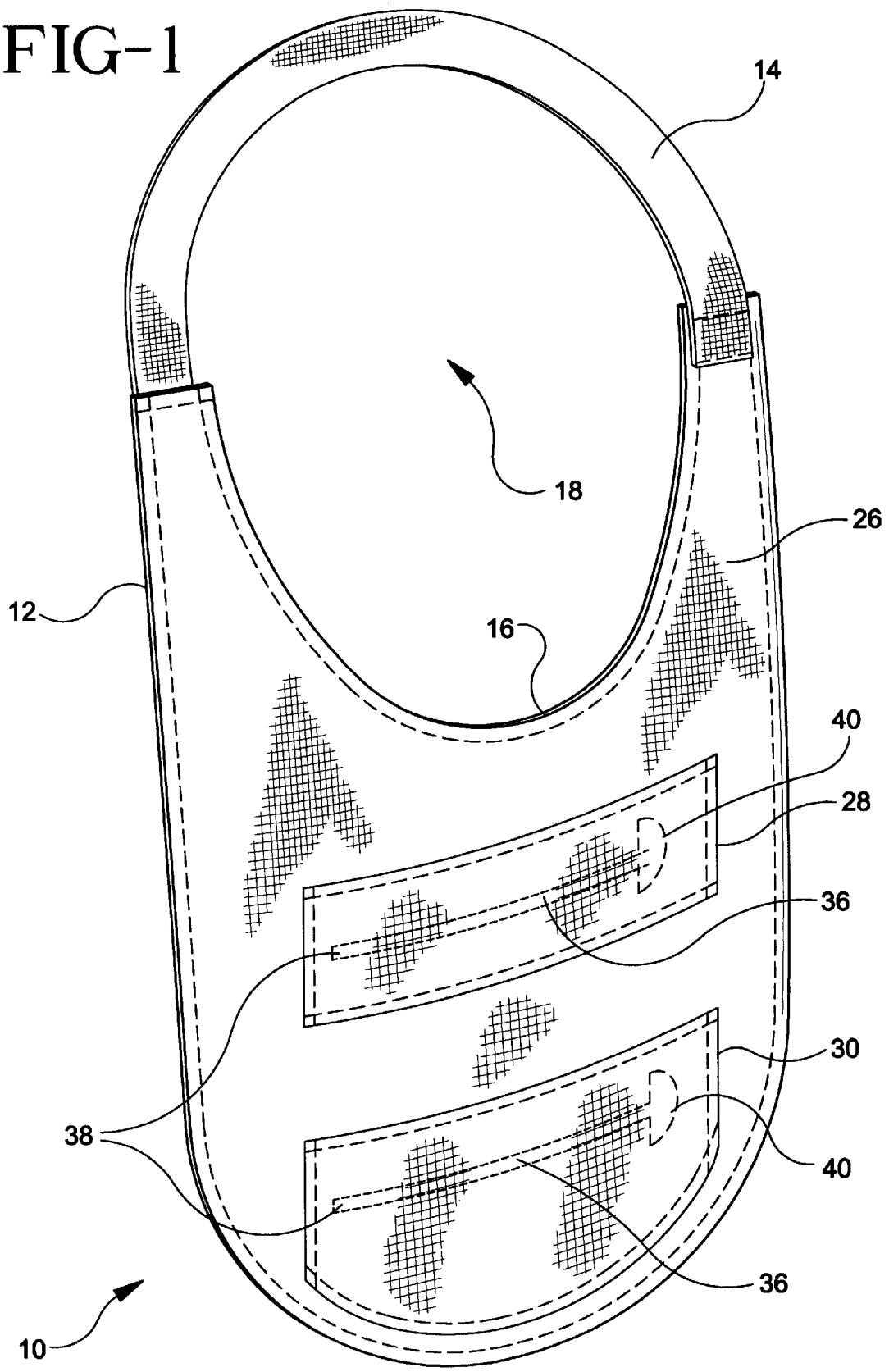
FIG. 1 is a rear perspective view of a disposable bib arrangement according to the present invention.
Figure 2:
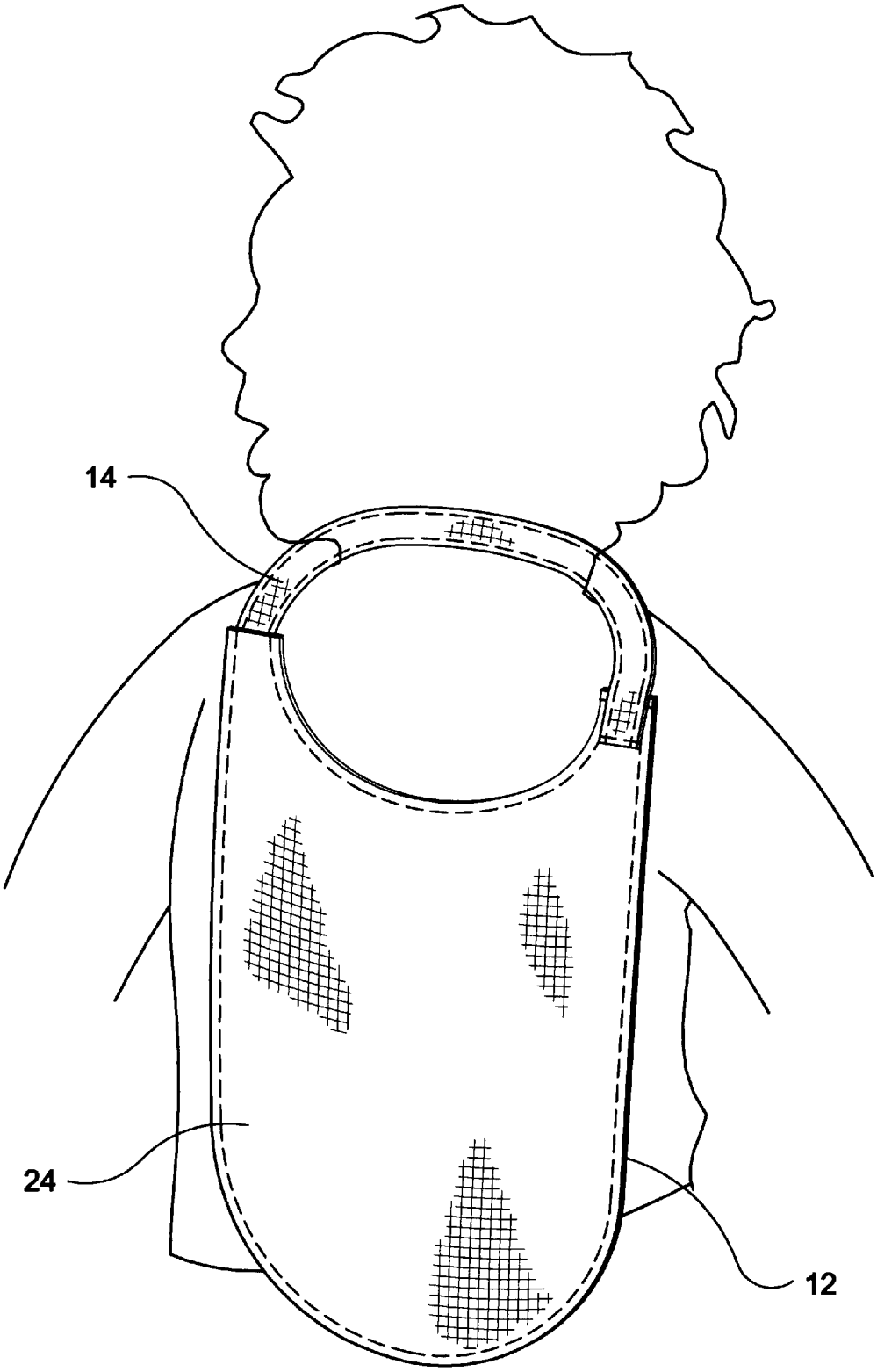
FIG. 2 is a front perspective view of the disposable bib of the present invention coupled to an infant.
Figure 3:
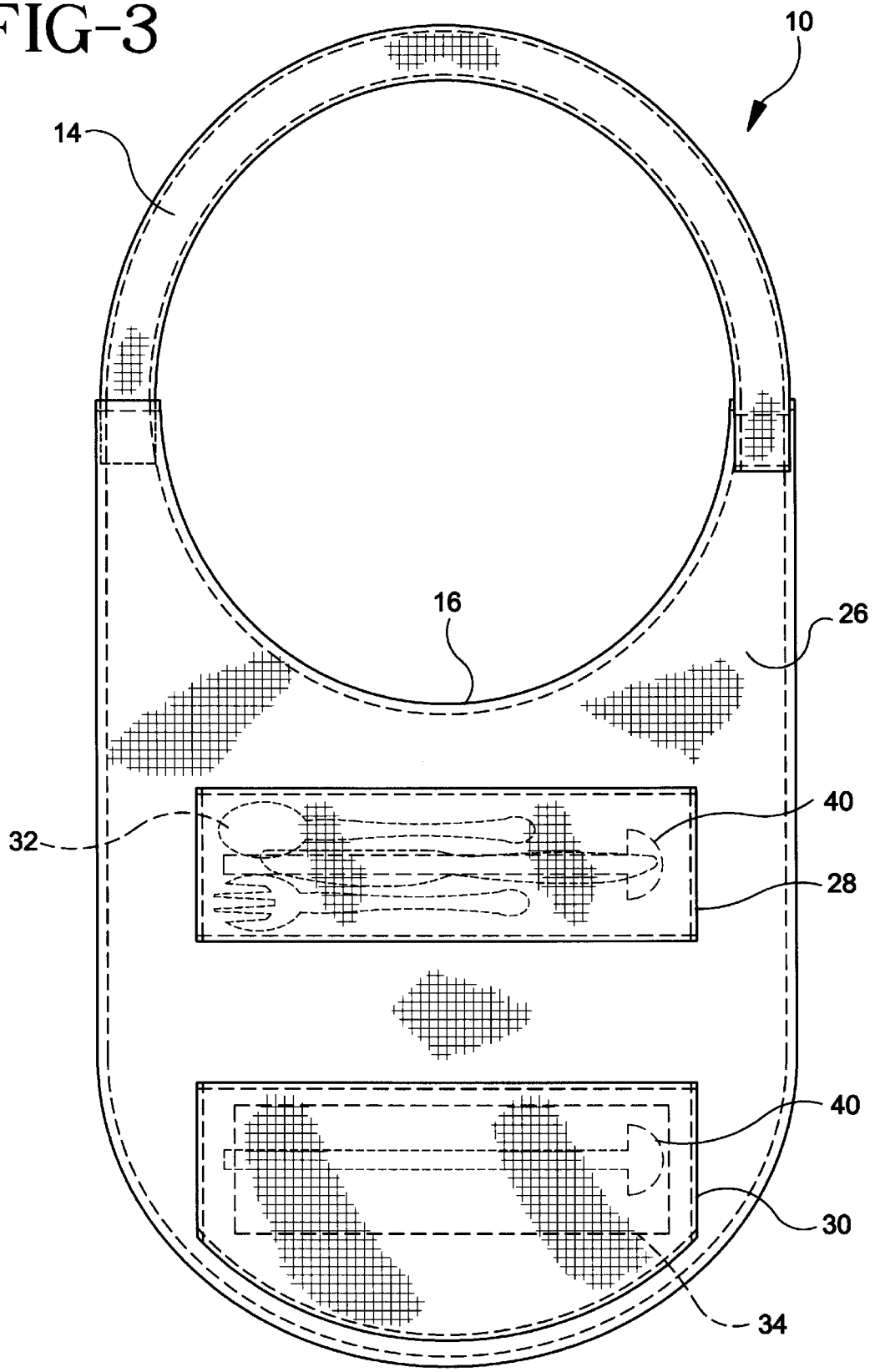
FIG. 3 is a plan view of the disposable bib showing utensils in phantom in one compartment formed on or within the disposable bib, and a second compartment having a towelette therein.
Figure 4:
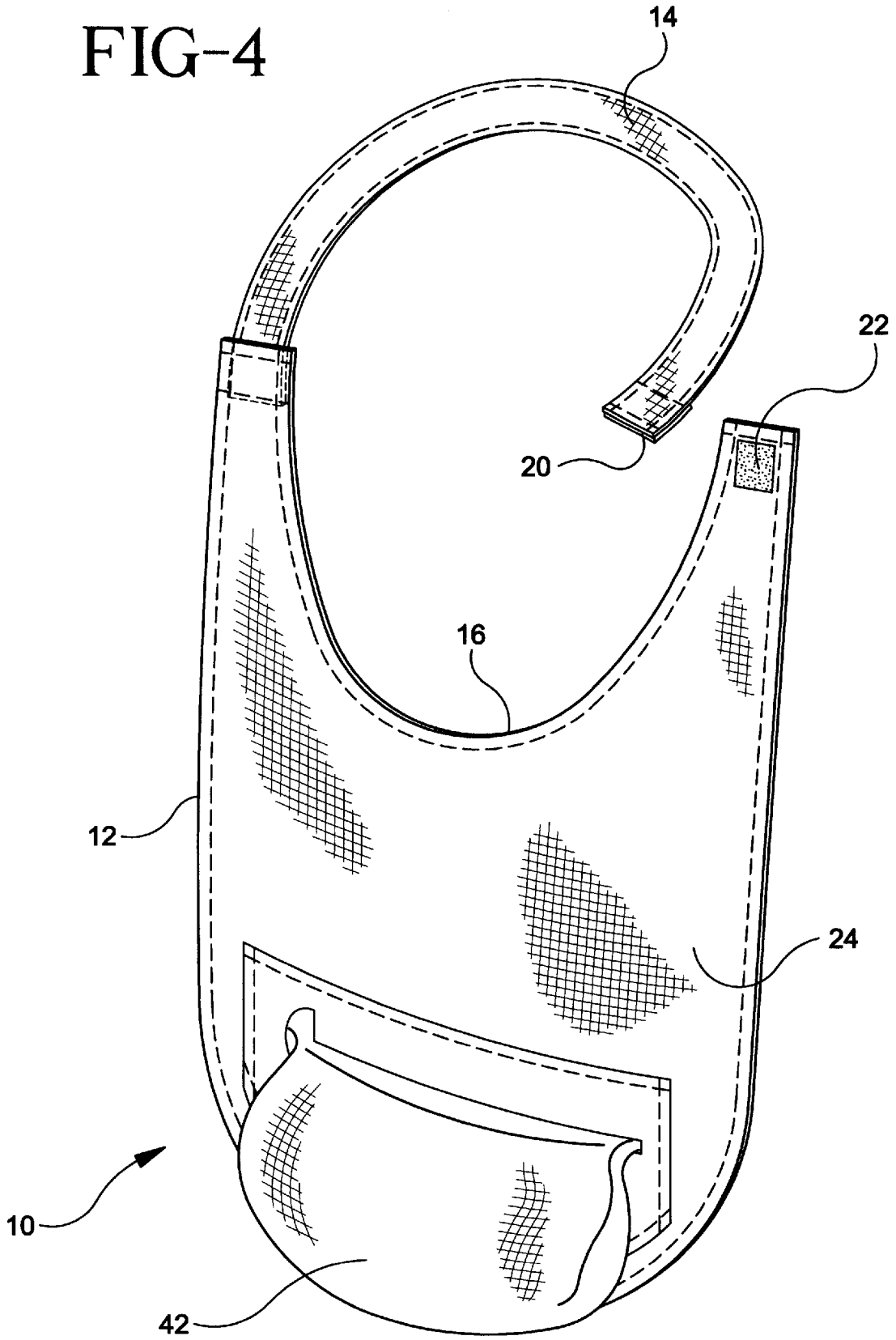
FIG. 4 is a front perspective view of the disposable bib arrangement showing tabs for securing the disposable bib about the person's neck.

Referring now to the drawings, the disposable bib 10 of the present invention includes a panel 12 of generally oval shape having an arcuate member 14 permanently affixed at one end thereof to the panel 12. The second end of the arcuate member is capable of being removably coupled to the panel. The arcuate member and an arcuate upper edge 16 of the panel define an opening 18 through which an infant's neck extends. Preferably, the second end of the arcuate member is decoupled from the panel to enable the arcuate member to be placed about an infant's neck and recoupled to the panel for securing the bib about the infant's neck.

In a preferred embodiment of the present invention, the arcuate member includes a VELCRO™ (that is, a hook and loop) tab 20 at an end portion 10 thereof and the panel includes a complementary VELCRO™ (that is, a hook and loop) tab 22 for enabling securement of the arcuate member 14 to the panel 12. It is foreseen that any other means of attachment including a snap-fit button or a button and hole configuration can be utilized to secure the arcuate member to the panel. It is also foreseen that the arcuate member 14 could be replaced by tie strings and the like which are permanently affixed to the panel 12 at opposite ends of arcuate upper edge 16 and which are tied about the infant's neck to secure the bib, or tape-like closures typically found on diapers. Alternatively the bib may include clips which secure the bib directly to clothing without traversing about the infant's neck.

In a preferred embodiment, a top-side surface 24 of the panel includes a material which is durable and absorbent in order to absorb any spills of food while the infant is being fed. A suitable durable and absorbent material for use as the top-side surface of the panel is a material similar to that of a reusable Handi-wipe™ manufactured by Softsoap Enterprises. The under-side surface 26 of the panel, which is designed to face toward the wearer, is preferably made of a material which is impervious to liquids to protect the wearer's clothing. A suitable liquid impervious material for use as the under-side surface 26 of the panel is a plastic covering similar to that of the outer shell of a diaper manufactured by Kimberly Clark Corporation. The underside panel 26 also includes first and second compartments 28, 30 preferably formed within the top-side and under-side panels for containing eating utensils 32, wipes 34 (moist towelettes) and any other article which would assist a parent in feeding an infant or cleaning an infant after having been fed. It is foreseen that even food can be provided and retained within the compartments.

In the preferred embodiment, the compartments 28, 30 are formed within the first and second surfaces of the panel such that the compartment is integrally formed within the bib. The compartments are preferably sealed in order to prevent access to the items stored therein prior to use. It is foreseen that the compartments may be airtight sealed in order to prevent the towelette and utensils from becoming unsanitary. Alternatively, the utensils and towelette can be stored in airtight sealed bags which are placed within the compartments. Therefore, the compartments need not be airtight if the utensils and towelette are sterilized. The compartments preferably include a tab 36 such as a tamper-proof, non-resealable kind so that it will be readily apparent to a user if the compartment has been previously opened. The non-resealable tab 36 which enables access to the compartments may include perforations 38 in the second surface of the panel which, when broken by pulling on a semicircular head 40 portion of the tab, enables access to the compartment.

It is foreseen that the compartments can be attached to either the top-side or under-side surface of the panel 12 instead of being positioned between the top-side and under-side of the panels.

In the preferred embodiment of the present invention, the first compartment 28 includes eating utensils 32 such as a fork, knife and spoon, and the second compartment 30 includes the towelette. It is foreseen that the disposable bib 10 can include only one compartment wherein the utensils 32 and wipe 34 are both included therein. If one compartment is utilized, either the wipe or the utensils may be enclosed in a bag contained within the compartment to prevent contamination of the utensils from the wipe and vice versa.

The compartment which holds the wipe is preferably constructed in a manner similar to a pocket such that the compartment can be oriented in an inside-out configuration 42. In the preferred embodiment after the disposable bib has been used for its intended purpose, the compartment which holds the wipe is preferably oriented inside-out and the bib is inserted therein along with the utensils and the wipe so that the used bib, utensils and wipe are retained in the compartment such that the unit can be safely and cleanly carried to a proper trash receptacle without dirtying one's hands on the soiled bib, utensils and/or towelette.

It is foreseen that a plurality of disposable bib arrangements of the present invention will be sold together in a package or box (similar to diapers) or singly, and that a parent take an arrangement (which includes necessary items for feeding an infant) if the parent expects to be away from home during the infant's mealtime. Alternatively, an arrangement can be stored in the parents' car or in the child's diaper bag as a back-up (emergency) in the event the parent is unexpectedly out of the house with the infant during meal-time.

While the invention has been described in connection with a preferred embodiment, it is not intended to limit the scope of the invention to the particular form set forth but, on the contrary, it is intended to cover such alternatives, modifications, and equivalents as may be included within the scope and spirit of the invention as defined by the appended claims. For example, the bib arrangement is not only intended for use with an infant as a travel convenience, but can be used on a disabled adult or an elderly person who require the same assistance during mealtime as an infant or the bib arrangement could be provided by a restaurant or fast food eatery for use by a patron (either an infant or an adult) especially when the patron is to eat the food away from the restaurant.

What is claimed is:

1. A disposable bib comprising:

a panel adapted to overlie a chest region of a wearer having a first surface designed to face outwardly from the wearer and a second surface designed to face toward the wearer; and a sealed compartment which is not re-sealable formed on or within the second surface of the panel for containing at least one of an eating utensil and a towelette therein.

2. The disposable bib as defined by claim 1, further comprising:

a member coupled to said panel for securing said panel about a neck of the wearer.

3. The disposable bib as defined by claim 2, wherein said member comprises a first closure device and the panel includes a second closure device coupled thereto complementary to the first closure device, for removably coupling the disposable bib about the wearer's neck.

4. The disposable bib as defined in claim 1, wherein said panel comprises:

a first layer including an absorbent material corresponding to the first surface; and a second layer including a liquid impervious material corresponding to the second surface.

5. The disposable bib as defined in claim 1, wherein said compartment is capable of being oriented in an inside-out configuration and is of sufficient size such that when the compartment is oriented in the inside-out configuration, the disposable bib can be placed within the compartment.

6. The disposable bib as defined in claim 1, wherein said compartment includes an arrangement for enabling access to an interior portion of said compartment for removing at least one of said eating utensil and towelette.

7. In combination:

a disposable bib comprising a panel adapted to overlie a chest region of a wearer having a first surface designed to face outwardly from the wearer, and a second surface designed to face toward the wearer;

a sealed compartment which is not resealable formed on or within one of the first and second surfaces of the panel; and at least one of an eating utensil and a towelette.

8. The combination as defined by claim 7, the disposable bib further comprising:

a member coupled to said panel for securing said panel about a neck of the wearer.

9. The combination as defined by claim 8, wherein said member comprises a first closure device and the panel includes a second closure device coupled thereto complementary to the first closure device, for removably coupling the disposable bib about the wearer's neck.

10. The combination as defined in claim 7, wherein said panel comprises:

a first layer including an absorbent material corresponding to the first surface; and a second layer including a liquid impervious material corresponding to the second surface.

11. The combination as defined in claim 7, wherein said compartment is capable of being oriented in an inside-out configuration and is of sufficient size such that when the compartment is oriented in the inside-out configuration, the disposable bib can be placed within the compartment.

12. The combination as defined in claim 7, wherein said compartment includes an arrangement for enabling access to an interior portion of said compartment for removing at least one of said eating utensil and towelette.

13. A method for disposing of a disposable bib, the method comprising the steps of:

providing a disposable bib which includes a panel adapted to overlie a chest region of a wearer having a sealed compartment including a non-resealable tab, the compartment containing at least one of an eating utensil and a towelette therein;

releasing the non-resealable tab to access the sealed compartment;

providing said compartment in an inside-out orientation; and inserting said disposable bib in said inside-out oriented compartment.

14. The method as defined by claim 13, further comprising the step of:

inserting at least one of the eating utensil and towelette in said inside-out oriented compartment.

15. A method of feeding a person using a disposable bib which includes a panel adapted to overlie a chest region of the person, the bib including a sealed compartment, having a non-resealable tab, the compartment containing an eating utensil therein, the method comprising the steps of:

releasing the non-resealable tab to access the first compartment;

removing the eating utensil from the first compartment of the disposable bib;

securing the disposable bib about the person's neck such that the panel overlies the chest region of the person;

utilizing the eating utensil removed from the sealed compartment to provide food to a mouth of the person; and removing the disposable bib from the person's neck.

16. The method as defined by claim 15 wherein the disposable bib also includes a second compartment for containing a towelette, the method further comprising the steps of:

removing the towelette from the second compartment of the disposable bib;

utilizing the towelette to clean at least one of a face and hand of the person.

17. The method as defined by claim 16, further comprising the steps of:

providing one of said first and second compartments in an inside-out orientation; and inserting said used disposable bib in said inside-out oriented compartment for compact and clean disposal.

18. The method as defined by claim 15, further comprising the steps of:

providing one of said first and second compartments in an inside-out orientation; and inserting said disposable bib in said inside-out oriented compartment.

19. In combination:

a disposable bib comprising a panel adapted to overlie a chest region of a wearer having a first surface designed to face outwardly from the wearer and a second surface designed to face toward the wearer; and a sealed compartment which is not resealable formed on or within the second surface of the panel.

20. The combination according to claim 19 wherein said compartment is capable of being oriented in an inside-out configuration and is of sufficient size such that when the compartment is oriented in the inside-out configuration, the disposable bib can be placed within the compartment to roll up the used bib and at least one of eating utensil and towelette for compact and clean disposal.

* * * * *